United States Patent [19]

Hennecke et al.

[11] Patent Number: 4,662,086

[45] Date of Patent: May 5, 1987

[54] RADIANT UNIT IN THE FORM OF A PORTAL, PARTICULARLY FOR USE AS A DRYING AND BAKING TUNNEL FOR THE AUTOMOBILE INDUSTRY

[75] Inventors: Udo Hennecke, Alzenau; Norbert Mittelstädt; Eberhard Müller, both of Hanau, all of Fed. Rep. of Germany

[73] Assignee: Heraeus Quarzschmelze GmbH, Fed. Rep. of Germany

[21] Appl. No.: 798,987

[22] Filed: Nov. 18, 1985

[30] Foreign Application Priority Data

Nov. 23, 1984 [DE] Fed. Rep. of Germany ... 8434317[U]

[51] Int. Cl.[4] ..... F26B 23/04

[52] U.S. Cl. ..... 34/229; 34/243 C; 34/4; 34/39; 118/642

[58] Field of Search ..... 34/4, 40, 39, 68, 222, 34/229, 243 C; 118/642, 643

[56] References Cited

U.S. PATENT DOCUMENTS 3,570,042 3/1971 Solomon ..... 34/243 C 4,416,068 11/1983 Nilsson et al. ..... 34/4

*Primary Examiner*—Larry I. Schwartz

*Attorney, Agent, or Firm*—Felfe & Lynch

[57] ABSTRACT

Disclosed is a self-contained radiant unit in the form of a portal for use particularly as a drying and baking tunnel for the automobile industry which is equipped with a plurality of infrared lamps on its inner surfaces. Air inlet openings are provided in the roof and/or side walls of the portal, at least over the region midway along with their horizontal extension, for the turbulence-free removal of the vapors emanating from the surface of the object being treated as well as of suspended particles present in the drying and baking zone.

12 Claims, 6 Drawing Figures

RADIANT UNIT IN THE FORM OF A PORTAL, PARTICULARLY FOR USE AS A DRYING AND BAKING TUNNEL FOR THE AUTOMOBILE INDUSTRY

BACKGROUND OF THE INVENTION

The invention relates to a radiant unit in the form of a portal equipped with a plurality of infrared lamps for use as a drying and baking unit and in particular for use as a drying and baking tunnel in the automobile industry.

From pamphlet Q-E1/14OP (April 1974 edition) of Heraeus Quarzschmelze GmbH, modular medium-wave infrared lamps are known which can be assembled in modular fashion to form planar infrared radiant units. For use in larger structures, these heating elements can be suspended from frames. Such modular lamps are used for drying and heating in the manufacture of small parts, in laboratories, and in the forming of thermoplastics.

For drying and baking of surface coatings, particularly in the automobile industry, the use of installations with infrared lamps of the type referred to above, for example, has proved highly advantageous since such installations can be kept very short, and since the heat required by the process can be directed onto the object with high precision. The ovens used in the automobile industry are constructed in the form of a portal equipped with individual infrared lamps and having a relatively short overall length, that is, an overall length considerably shorter than the vehicle being conveyed through the portal. In such drying and baking operations, it is important that the volatilized solvents, or other vapors or suspended particles present in the space, not deposit on the object being treated. Thus the air in the heating chamber surrounding the portal is continuously exhausted and cleaned, and filtered air is introduced.

SUMMARY OF THE INVENTION

An object of the present invention is to provide a radiant unit which is self-contained and which assures the immediate and substantially turbulence-free removal of the vapors emanating from the surface of the object being treated as well as of suspended particles present in the drying and baking zone.

In accordance with the invention, this object is accomplished in that air inlet openings are provided in the roof and/or side walls of the portal at least over a region midway along their horizontal extension. Through these air inlet openings disposed in the midregion of the radiant unit, that is, over a region midway along its overall length, air free of impurities and vapors can be continuously supplied to the treating zone and then exhausted on both sides of the portal, that is, on the entrance side and on the exit side. The air flow is from the middle of the portal toward its ends, and turbulence therefore is largely avoided. Since such a radiant unit has an air inlet system of its own in addition to the lamps, it can be used substantially without regard to the location where it is being employed, that is, without regard to the ambient air. A plurality of such self-contained radiant units can readily be combined to form a structural unit of considerable length without the use of supplemental means.

A radiant unit of this type where a suction duct with suction openings extending toward the interior of the portal is disposed at both end faces of the portal has proved particularly practical. The clean air fed to the treating zone through the air inlet openings is exhausted immediately through these suction openings, and the environs of the portal therefore are not polluted by vapors given off by the surface exposed to radiation. Individual radiant units which are to be combined to form a tunnel usually require a suction duct at only one of their end faces, of course, so that when the units are assembled there is alternately an air inlet zone and an exhaust zone.

Drying and baking installations must nearly always be designed for a specific application and for the particular coating material to be treated. Especially from this point of view, a suction duct that is detachably attached by means of flanged joints, for example, to the basic element having the air inlet openings is advantageous in that it permits an installation to be assembled from two prefabricated units, that is, the radiant unit with the air inlet openings, and the suction duct.

A further advantage of the radiant unit is that since it is constructed to be fully operational and ready to use, it can be added to existing radiant units if a process is modified, and that when a process is being discontinued it can be used in other divisions of the plant for other purposes individually or as part of a newly assembled installation. Each radiant unit is a complete infrared unit with its own air inlet and optionally exhaust system, which permits differential heating of the drying and baking zones, or greater differentiation within the drying zone on the basis of the amount of solvent being volatilized, without necessitating major capital outlays for construction. With such self-contained units, it is very easy to obtain in the various sections of an installation the requisite temperature profile, which may differ from one section to the next.

Depending on the width of the radiant unit, that is, on the length over which it extends, the air inlet openings in its midregion may be supplemented by further air inlet openings whose cross-sectional area should be decreasing in the direction of the ends of the portal to obtain a uniform inlet air stream in the treating zone.

A particularly simple arrangement is obtained when the roof and/or side walls of the portal which are provided with air inlet openings form the walls of an inlet air distribution space. Only one air inlet connection, located preferably in the roof area of the portal, is then required, and an air-cleaning filter may be inserted in it. To secure uniform distribution of the inlet air to the air inlet openings by means of such an air distribution space, it may be advisable to provide it with baffles for forcibly directing the inlet air. In addition to the air-cleaning filter, a blower may be disposed both in the air inlet connection and in the central exhaust duct, which is likewise preferably located in the roof area of the portal and through which the air drawn through the suction openings is exhausted. In radiant units equipped with both an air intake blower and an exhaust blower, the two blowers may be combined in a structural unit having a common drive.

To facilitate the handling of such radiants units still more, the portal may be divided into two sections of identical construction, each forming a half portal. Each radiant unit should be provided on at least one end face but preferably on both end faces with connecting means for further portals whereby several such portals can be joined together, as mentioned earlier.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF A PREFERRED EMBODIMENT

Figure 1:
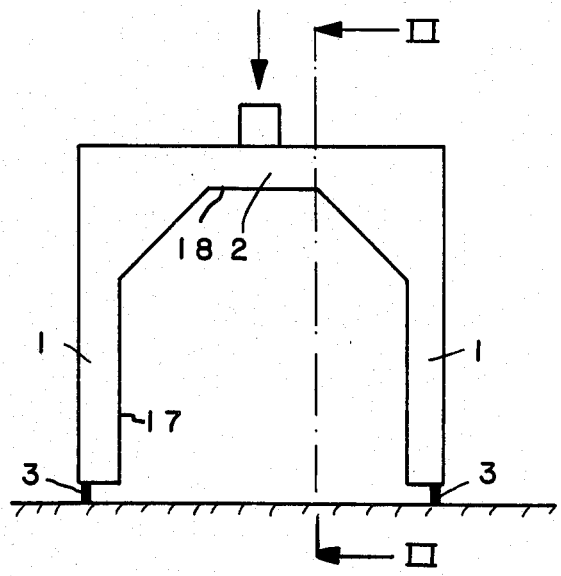
FIG. 1 is a front elevation of a radiant unit in accordance with the invention.
Figure 2:
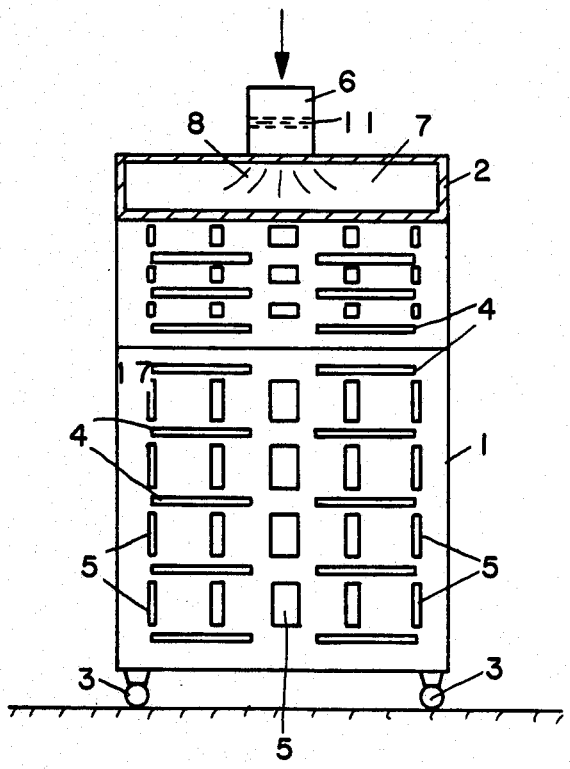
FIG. 2 is a sectional view taken along the line II—II in FIG. 1.

As shown diagrammatically in FIGS. 1 and 2, the radiant unit is in the form of a portal comprising sections 1 forming side walls and a roof section 2. Rollers 3 on which the portal can be moved are provided at the free ends of the side walls 1. Side walls 1 and roof 2 each have inner surfaces 17 and 18 respectively forming the inside of the portal, and on which a plurality of individual rodlike infrared lamps 4, aligned with and spaced from one another, is disposed. In place of these infrared lamps 4, individual ultraviolet lamps may be used. A plurality of air inlet openings 5 are disposed in such a way that they form five vertical rows. The cross-sectional area of these air inlet openings decreases from the middle row toward the outer rows. As a result, considerably more air is suplied to the treating zone from the midregion of the portal than from the outer regions, which makes for uniform airing of the treating zone. The air inlet openings may, of course, have any cross section conducive to favorable air flow. Moreover, they need not be arranged in a five-row pattern. What is important is that their cross-sectional area decrease in the horizontal direction from the midregion toward the end faces of the portal.

In the embodiment shown in FIG. 2, the inlet air first passes through an air inlet duct 6 in the roof of the portal into an inlet air distribution space 7, from where the inlet air is then uniformly distributed to the air inlet openings 5, aided by baffles 8 in the distribution space 7. Suction ducts 9 may be detachably attached by means of flanged joints, for example, to the outer surfaces of the radiant unit shown in FIG. 2, these ducts being provided with internal suction openings or slots 10 through which the air passing from the air inlet openings 5 into the treating zone and cleaned by a filter 11 disposed in the air inlet duct 6 is drawn off. This air is exhausted through an exhaust duct 12, disposed at the top of each suction duct 9, where it may be cleaned by means of a further filter 13 disposed in the exhaust duct 12. Air inlet and exhaust are indicated by arrows 14 and 15, respectively.

Figure 3:
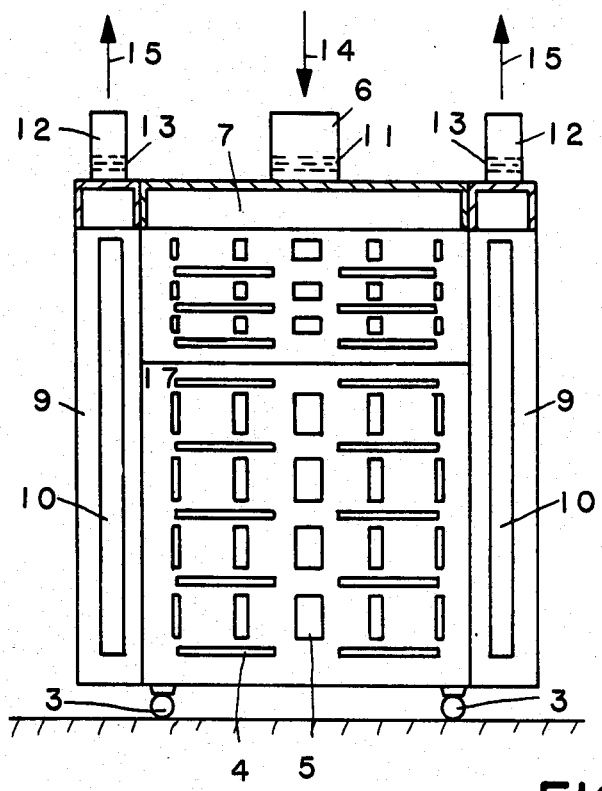
FIG. 3 shows the radiant unit illustrated in FIGS. 1 and 2 with two additional suction ducts on the outer surfaces.
Figure 4:
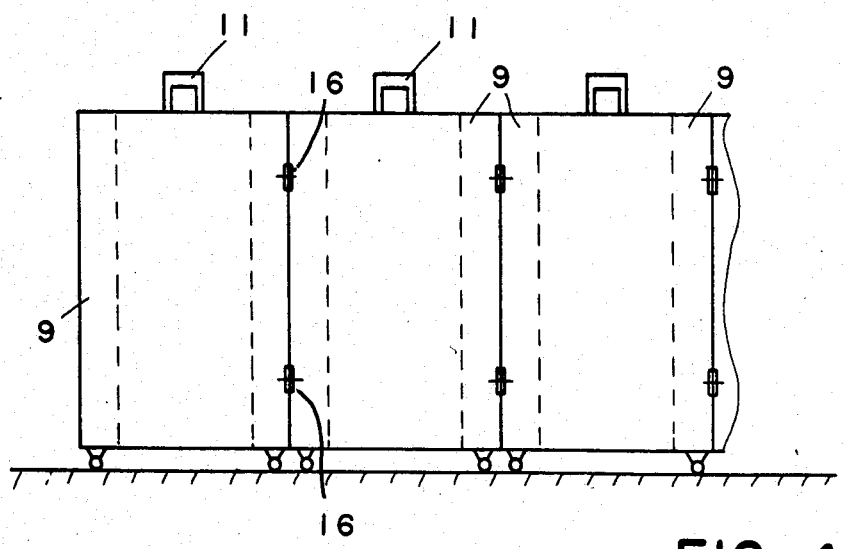
FIG. 4 shows a radiation installation assembled from a plurality of radiant units.

If necessary, several of the radiant units shown in FIG. 3 can be coupled together with connecting means 16 to form structural units or tunnels of greater length, as shown diagrammatically in FIG. 4.

Figure 5:
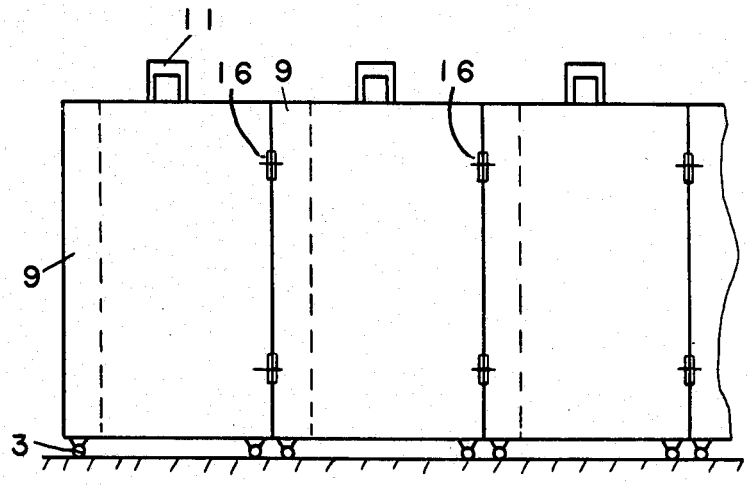
FIG. 5 shows an installation slightly modified with respect to the installation illustrated in FIG. 4.

In the arrangement shown in FIG. 5, each radiant unit consists of a portal section comprising air inlet openings 5 and 6 of a single suction duct 9 disposed on one side. The radiation tunnel comprises alternately a suction duct 9 and a portal section with air inlet openings. However, the arrangement might also be such that two portal sections wit air inlet openings are coupled directly together without a suction duct 9, as shown on the left in FIG. 5.

Figure 6:
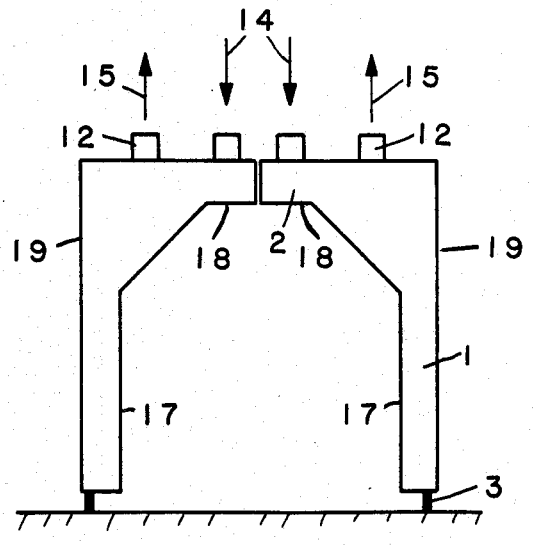
FIG. 6 shows a radiant unit divided into two half portals.

For ease of handling, and also to simplify manufacture, the portal shown in FIG. 6 is divided into two sections 19, each forming a half portal. These sections are bolted together in the roof area of the radiant unit.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

What is claimed is:

1. An irradiating unit in the form of a portal having sidewalls and a roof, said portal also having a plurality of radiating means, disposed therein said roof and sidewalls having air inlet openings at least in a central region thereof, facing toward the interior of the portal wherein an air-evacuation channel is disposed at least on one face of the portal with aspirating holes constructed towards the interior of the portal, the air-evacuation channel running completely around the face of the portal to provide turbulence free removal of vapors.

2. The radiant unit of claim 1, wherein it is a drying and baking tunnel for the automotive industry.

3. The radiant unit according to claim 1, wherein the suction duct is detachably attached.

4. The radiant unit according to claim 1, further comprising at least one additional air inlet opening in the roof and/or side walls of the portal, said additional air inlet opening having a cross-sectional area which decreases in the horizontal direction from the midregion to the end faces of the portal.

5. The radiant unit according to claim 1, wherein the roof and/or side walls of the portal which comprise air inlet openings form the walls of an inlet-air distribution space.

6. The radiant unit according to claim 1, wherein the roof comprises an air inlet connection.

7. The radiant unit according to claim 5, wherein baffles are disposed in the inlet air distribution space.

8. The radiant unit according to claim 6, further comprising air moving means disposed in the inlet air connection.

9. The radiant unit according to claim 8, wherein the air moving means is a blower which exhausts air by suction from at least one exhaust duct disposed in the roof of the portal.

10. The radiant unit according to claim 9, further comprising an inlet air blower which with the exhaust blower form a structural unit having a common drive.

11. The radiant unit according to claim 1, wherein the portal is divided into two sections, each forming a half portal.

12. The radiant unit according to claim 1, wherein the portal is provided with connecting means for connecting the portal to a second portal.

* * * * *